US007243496B2

(12) United States Patent
Pavlik et al.

(10) Patent No.: US 7,243,496 B2
(45) Date of Patent: Jul. 17, 2007

(54) ELECTRIC FLAME CONTROL USING CORONA DISCHARGE ENHANCEMENT

(75) Inventors: Dennis Pavlik, Murrysville, PA (US); David Walter Branston, Effeltrich (DE); Guenter Lins, Erlangen (DE); Thomas Hammer, Hemhofen (DE)

(73) Assignee: Siemens Power Generation, Inc., Orlando, FL (US)

( * ) Notice: Subject to any disclaimer, the term of this patent is extended or adjusted under 35 U.S.C. 154(b) by 517 days.

(21) Appl. No.: 10/767,063

(22) Filed: Jan. 29, 2004

(65) Prior Publication Data

US 2005/0170301 A1 Aug. 4, 2005

(51) Int. Cl.

| | |
|---|---|
| ***F02C 3/22*** | (2006.01) |
| ***F23R 3/16*** | (2006.01) |
| ***F23R 3/18*** | (2006.01) |
| ***F23D 14/74*** | (2006.01) |

(52) U.S. Cl. ..... 60/776; 60/737; 60/39.821; 431/2; 431/8

(58) Field of Classification Search ..... 60/776, 60/737, 39.821, 39.827; 431/2, 4, 8
See application file for complete search history.

(56) References Cited

U.S. PATENT DOCUMENTS

| | | | | |
|---|---|---|---|---|
| 2,604,936 | A * | 7/1952 | Kaehni et al. | 432/9 |
| 2,963,864 | A * | 12/1960 | Gross | 60/39.827 |
| 3,035,412 | A * | 5/1962 | Jules | 60/776 |
| 3,416,870 | A * | 12/1968 | Wright | 431/2 |
| 3,841,824 | A * | 10/1974 | Bethel | 431/2 |
| 4,020,388 | A | 4/1977 | Pratt, Jr. | |
| 4,041,922 | A | 8/1977 | Abe et al. | |
| 4,124,003 | A | 11/1978 | Abe et al. | |
| 4,219,001 | A | 8/1980 | Kumagai et al. | |
| 4,439,980 | A | 4/1984 | Biblarz et al. | |
| 5,040,371 | A * | 8/1991 | Shekleton | 60/748 |
| 5,303,554 | A * | 4/1994 | Faulkner | 60/737 |
| 5,413,879 | A | 5/1995 | Domeracki et al. | |

FOREIGN PATENT DOCUMENTS

| | | |
|---|---|---|
| WO | WO 96/01394 | 1/1996 |

OTHER PUBLICATIONS

J. Lawton, P.J. Mayo and F.J. Weinberg, Electrical Control of Gas Flows in Combustion Processes, Apr. 17, 1967, p. 275-298, vol. 303, Imperial College, London.

(Continued)

*Primary Examiner*—Ted Kim

(57) ABSTRACT

A method of operating a combustor (10), to provide intimately mixed hot combusted gas (44) for a gas turbine (46), includes feeding gaseous oxidant (12) and gaseous fuel (16) into the combustor (10) near a combustion flame (28) which has a tip end (39) and a root end (29), where corona discharge occurs through adjustment of an electric field (34), and where the corona discharge causes ionized particles (36) to form and also causes intimate turbulent mixing of the gases.

20 Claims, 3 Drawing Sheets

OTHER PUBLICATIONS

Hartwell F. Calcote and Robert N. Pease, Electrical Properties of Flames, Industrial and Engineering Chemistry, Dec. 1951, p. 2726-2731, vol. 43, No. 12, Princeton University, Princeton, N.J.

H.F. Calcote, Ion Production and Recombination in Flames, 8th International Symposium On Combustion, 1962, p. 184-199, Williams and Wilkins.

H.F. Calcote and C.H. Berman, Increased Methane-Air Stability Limits by a DC Electric Field, Fossil Fuel Combination Symposium, Jan. 1989, pp. 25-31, vol. PD 25, Houston, Texas.

C.H. Berman, R.J. Gill, H.F. Calcote and T.Y. Xiong, Enhanced Flame Stability Using Electric Fields, Aero-Chem Tp-511 Final Report for the Gas Research Institute, Apr. 1993, Final Report May 1991-1992.

* cited by examiner

ELECTRIC FLAME CONTROL USING CORONA DISCHARGE ENHANCEMENT

BACKGROUND OF THE INVENTION

1. Field of the Invention

The present invention relates to an electric field enhanced combustion stabilizer that utilizes an electric field and corona discharge to improve the mixing and combustion characteristics of combustor assemblies used in combustion turbines.

2. Background Information

Combustion turbines burn hydrocarbon fuels such as methane gas mixed with large volumes of air to power a turbine. The stability of the combustion and the chemical by-products, among other parameters, are dependent on how efficiently the gas is mixed with the air and the configuration of the burner elements. One example of a combustor to heat gas for a gas turbine generator is taught by U.S. Pat. No. 5,413,879 (Domeracki et al.).

The concept of imposing an electric field with a combustion turbine combustor, to augment the mixing and configuration stabilizing elements appeared attractive based on relatively low pressure, low velocity experimental work, in particular that of Calcote, such as Calcote, H. F. & Pease, R. N., "Electrical Properties of Flames," *Industrial & Engineering Chemistry*, Vol. 43, December 1951, pp. 2726–2731; Calcote, H. F. "Ion Production and Recombination in Flames," 8*th International Symposium on Combustion*, LOC 55-9170, Williams & Wilkins 1962, pp. 184–199; Calcote, H. F., Berman, C. H., "*Increased Methane-Air Stability Limits by a DC Electric Field*," Fossil Fuel Combustion Symposium, Houston Tex., January 1989, vol. PD 25, pp 25–31; and Berman, G. H., Gill, R. J., Calcote, H. F., and Xiong, T. Y., "Enhanced Flame Stability Using Electric Fields." Final Report May 1991–1992, *Aero-Chem Tp*-511 *Final Report for the Gas Research Institute*, April 1993. The major focus of the last work was to screen the feasibility of applying electric fields to control combustion in practical combustors. Three combustion systems were chosen for study; two industrial burners: an IGT low $NO_x$, $1\times10^6$ Btu/h cyclonic burner and a General Electric research gas turbine burner; and a residential commercially available GE home range burner. The major effort was on the IGT Industrial Burner. Some conclusions were that a dc electric field can improve flame stability at high excess air operation in a cyclonic combustor; that application of an electric field using a torus electrode improved flame stability in an IGT cyclonic combustor, as evidenced by reduced emissions of both CO and total hydrocarbons without affecting the already low levels of $NO_x$; and that negligible electric power is required for stabilization in large systems. They also concluded that the major effect of the dc electric field was to prevent the increase in CO and total hydrocarbons that often occurs when a burner is operated out of its stable design range by attaining more complete combustion.

A variety of work has been done on internal combustion engines, utilizing corona discharge between spark gap electrodes; utilizing convection, and applying an electric field to segregate large fuel particles; and working with air-fuel mixtures to utilize very lean mixtures and to reduce the quantity of exhaust gases, as described in U.S. Pat. Nos.: 4,041,922; 4,124,003; 4,020,388; and 4,219,001 (Abe et al.; Abe et al.; Pratt; and Kumagai et al. respectively). Biblarz et al., in U.S. Pat. No. 4,439,980, taught electrodynamic control of fuel injection into aircraft gas turbines to allow use of fuels having high aromatic content. Most of these patents deal with air and droplets of fuel of various types.

The use of electrostatic fields to control the shape and thermophysical characteristics of flames has been established, for example, by Calcote and Pease in their 1951 article, cited previously. However, using electric fields to significantly impact high velocity turbulent flames has not been demonstrated. Prior art has assumed that improvements to flame stability require kinetic mixing of gases whether by mechanical or electrical means. The efforts at improving stability by electrical means were directed at changing the apparent burning velocity to anchor the flame to the burner. Prior art, as described in "Electrical Control of Gas Flows in Combustion Processes", by Lawton, J., Mayo, P. J., and Weinberg, F. J., Proc. Roy, Soc. 1968, vol. A303, pp. 275–298, concluded that it is not possible to change the burning velocity by more than about 5 m/s, therefore it was thought that as the gas velocity increases above this limit, electric fields become increasingly less effective.

Johnson, in PCT International Application WO 96/01394, discusses electrode arrangements for use in a combustion chamber having a flame zone located between the electrodes where a corona discharge ionizes the air used for the combustion process. Combustion is affected in the flame zone, reducing smoke particles, hydrocarbons, carbon monoxide and nitrous components in the exhaust gas. The object of that invention was to obtain devices which provide efficient combustion in a combustion chamber with open flame combustion to reduce harmful substances in the exhaust gas, as well as to form electrical and electromagnetic, discharges and conditions which influence combustion reactions to proceed in an optimum manner to reduce emissions. The frequency of pulsed direct current was thought important for controlling the discharge process.

The field development of processes and mechanisms to increase the effectiveness of an electric field in a combustor, so that it can influence flames in the high velocity turbulent region of the combustion process, would be commercially desirable to improve operation of combustion turbines.

SUMMARY OF THE INVENTION

It is therefore one of the main objects of the invention to provide utilization of an electric field to, in part, control the shape and characteristics of a turbulent flow combustion flame and cause corona discharge at or near an interface of gaseous oxidant and gaseous fuel.

These and other objects are accomplished generally by: providing gaseous oxidant and a combustible gaseous fuel; mixing the gaseous oxidant and gaseous fuel, where the gaseous oxidant has a velocity relative to the fuel which is sufficient to cause turbulent mixing with the fuel; and combusting the gaseous fuel in the region of a combustion flame and an electric field, where the electric field produces an electrical stress resulting in the local breakdown of the mixture of gaseous oxidant and fuel, and a corona discharge that in turn generates intimate turbulent mixing of the gaseous oxidant and fuel. This method relates to what is known as a diffusion flame process and a premix flame process.

The invention also includes a method for mixing gaseous fuel and gaseous oxidant and combusting the mixture, prior to passing to a gas turbine comprising: feeding combustible gaseous fuel to an enclosed combustor through at least one fuel feed tube and providing at least one combustion flame within the enclosed combustor at the end of the fuel feed tube, the flame having a top flame tip and a bottom root end at the end of the feed tube; feeding gaseous oxidant to contact gaseous fuel near the combustion flame; and then providing an electric field in the region of the combustion flame; and then adjusting the velocity of the gaseous oxidant to provide turbulent flow and turbulent mixing with the gaseous fuel near the root end of the flame, to provide combustion and ionization of the gases at least at their contact interface; and then adjusting the electric field to provide a corona discharge to enhance ionization, and turbulent mixing of the gases which in turn improves combustion; and then passing the hot combusted mixed gases to a gas turbine. This method relates primarily to a diffusion flame process.

As used herein, "corona discharge" means the generation of a localized region of charged particles (positive ions and electrons) in a region of high electric field strength. Corona discharge is also referred to as a "partial" or "local discharge" sufficient to cause ionization of a gas in a localized region.

The invention further relates to a gas turbine system comprising a gas turbine system comprising a combustor, a gas turbine, an air compressor, and an electric generator; where the combustor combusts gaseous oxidant and gaseous fuel and feeds the hot gaseous combustion products to the gas turbine; where the combustor comprises: (A) a combustion flame within the combustor; (B) at least one entry for gaseous oxidant feed and gaseous fuel feed; and (C) an electric field which is generated at or through the combustion flame, where the electric field is effective to cause ionization resulting in a corona discharge, which would increase turbulent flow mixing of the gaseous fuel and gaseous oxidant before they undergo a combustion reaction.

The gaseous oxidant is air and the preferred gaseous fuel is methane or a natural gas mixture of hydrocarbons. The volume ratio of methane to air is from about 1:5 to about 1:100, where the air is fed at sufficient velocity to cause turbulent mixing of the fuel. This process provides reduced emissions of nitrogen oxides.

These and other aspects of the present invention will be more apparent from the following description, when considered in conjunction with the accompanying non-limiting drawings.

DESCRIPTION OF THE PREFERRED EMBODIMENTS

Figure 1:
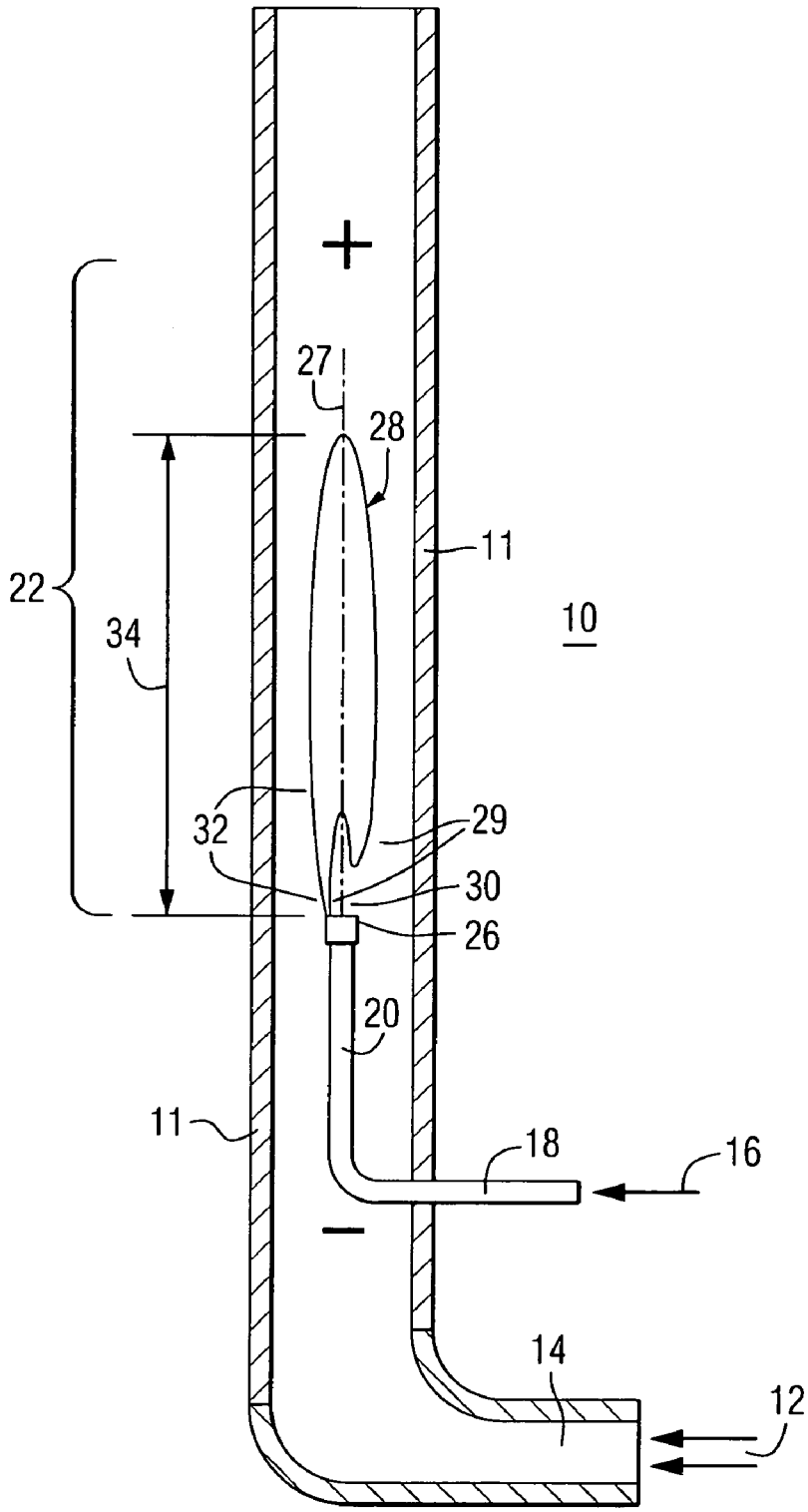
FIG. 1, which shows one embodiment of the invention, is a simplified cross-sectional view of one embodiment of an apparatus, such as a combustor, illustrating the invention, showing air and gaseous fuel entry and the combustion flame.

Referring now to FIG. 1, in order to illustrate the invention, one embodiment of the apparatus, which can act as a combustor 10, having combustor walls 11, is shown. Air oxidant 12 enters the combustor at air feed entrance 14, pressurized from 1.5 atmospheres to 40 atmospheres (1.5 bar to 40 bar), preferably pressurized from 5 atmospheres to 35 atmospheres (5 bar to 35 bar). Combustible gaseous fuel 16, preferably a hydrocarbon fuel, enters at fuel feed entrance 18. The fuel feed tube 20 feeds fuel to the main combustion mixing area, generally shown at 22. The tube 20 can be supplied with an electrical charge, preferably with a negative charge. The end of the tube 20 is shown as 26. An opposite charge, usually a positive charge, is supplied at or about the top of the flame 28. The end 26 of the fuel feed tube functions as a burner for combustion flame 28 which is shown lifting, having its bottom root end 29, being in some instances "blown-off" the fuel feed tube end 26, except for at least one contact point 30. The axial length of the flame is shown as 27. It is in and around the contact point, at an ionization zone 32, within the main combustion mixing area 22 that ionization and turbulent mixing of charged particles occurs.

The application of an electric field also influences turbulent mixing of the fuel 16 with the oxidant 12 which in turn improves/influences combustion properties. The volume ratio of gaseous fuel:gaseous oxidant is from about 1:5 to about 1:100, preferably from about 1:5 to 1:75 and the gaseous oxidant at the entry into the combustor has a velocity sufficient to cause turbulent flow. The oxidant velocity is from about 50 meters/second to about 2000 meters/sec., preferably from about 60 meters/second to about 500 meters/second.

The method of this invention utilizes an electric field which is adjusted to provide a corona discharge, which together control the shape and characteristics of a turbulent flow combustion flame 28. A novel feature of this invention is the deliberate introduction of a stabile, field generated source of charged particles, that is, the corona initiation source, to increase the charged particle density and thereby enhance the effectiveness of the electric field, shown generally as 34 between a positive and a negative charge.

When complete breakdown occurs a high current flows, and the field is reduced to a low value. The energy from the power supply is channeled into a useless, and sometimes destructive electrical arc. We have found that a stabile "corona" generated ion source is practical and does enhance the effectiveness of the electrical field. The optimum asperity configuration used to create the corona discharge and the optimum electric field profile vary depending on a number of factors. These include: the species of gas being burned; the specific velocities, temperatures, and pressure of the fuel; and the shape of the desired flame. A stable corona discharge supplies charged particles and enhances the effectiveness of the field and the use of an electric field to modify the combustion process.

Figure 2:
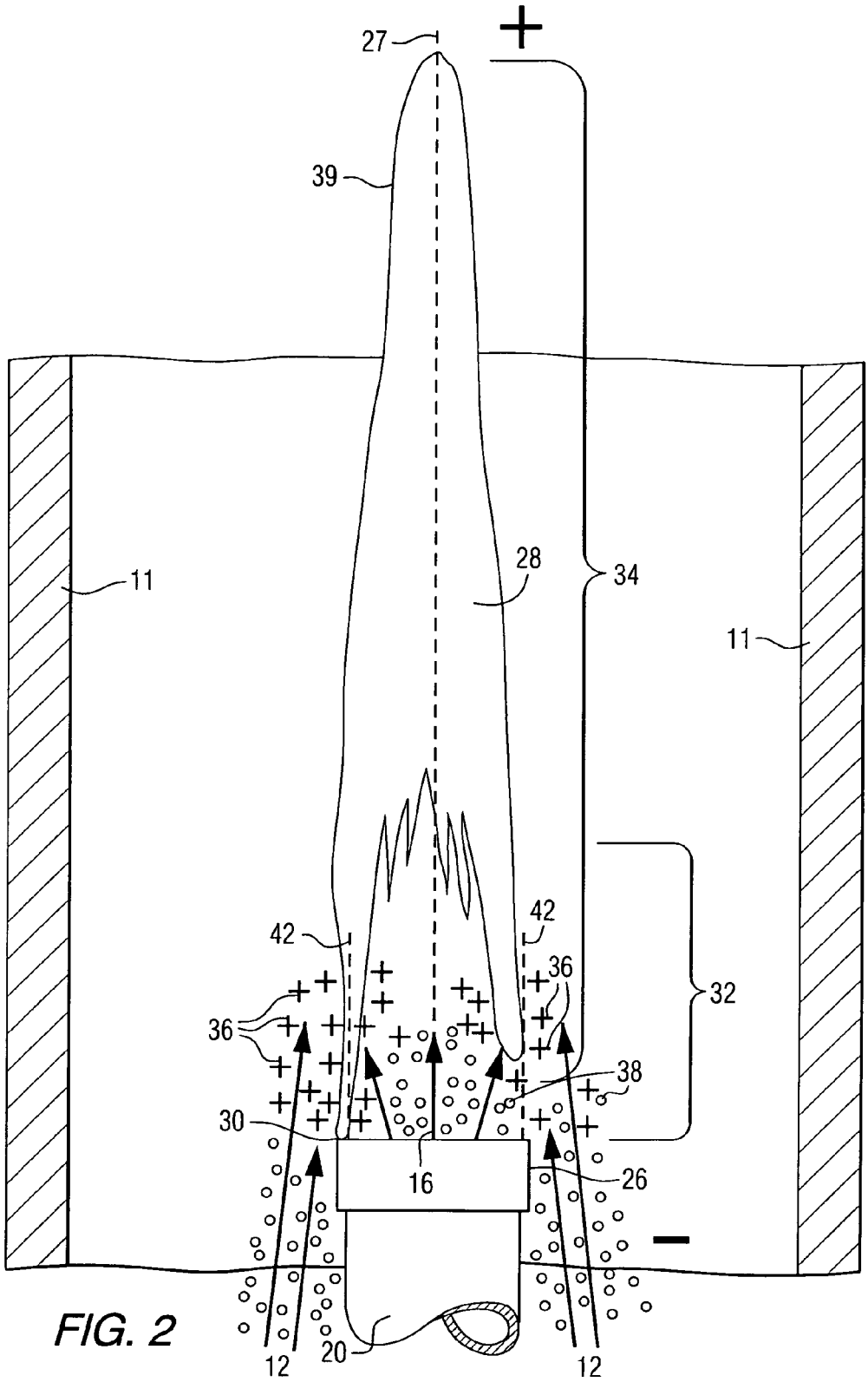
FIG. 2 is an idealized magnified view of the combustion flame showing an electric field in idealized form and the interface between feed gaseous oxidant and feed gaseous fuel.

FIG. 2 shows an idealized, close up view of the end 26 of the fuel feed tube 20 showing how the combustion flame 28, at near blow-off conditions, has or has almost lifted off the burner end 26 except at one or more points 30, which are producing charged particles 36 (idealized and shown as +signs), and a flame holding point, at or near the point 30, which is also the onset point of corona discharge. Ionized particles are shown as positive signs (+) 36 and molecular oxidant and fuel are shown as zeros (o) 38 (idealized). Axial electric field 34, also shown in FIG. 1, along the axial length 27 of the flame 28 is shown extending from end 26 of the fuel feed tube to the flame tip 39. Owing to the conductivity of the flame, the ionization caused by the combined effects of the electric field and the corona discharge is concentrated near the interface 42" between the gaseous oxidant and gaseous fuel, where the interface is shown as a dashed line in FIG. 2.

The air 12 must be of sufficient velocity to cause turbulent mixing with the fuel 16. As combustion turbine devices operate using turbulent mixing of the fuel and air, it is essential that electrically enhanced mixing occurs in an environment with turbulent mixing. A voltage applied at or near sharp contact point 30 produces a highly localized electrical stress sufficient to cause local breakdown and ionization of the air as it flows up the tube. The onset point of this corona discharge was generally seen in experiments as a white spot at the flame root at point 30.

When the electric field 34 was generated and the corona discharge at the asperity point 30 was present, the blow-off velocity (as defined by the maximum air flow rate just prior to the flame extinguishing) was more than doubled. When the voltage applied was insufficient to generate a corona discharge, the blow-off velocity was only slightly increased. Experiments clearly showed that the corona discharge was essential to the increased blow-off, demonstrating stability for a leaner burning mixture.

The electric field and ionization effects are concentrated on the boundary between the fuel and air, or gaseous oxidant. At this point it is important to increase the mixing velocity at the interface where differential velocities are much lower than the average gas velocities. The onset point of the discharge on the burner acts as a flame anchoring point, and disturbs the velocity profile causing a local ionization of the gases, both fuel and air. This electrical ionization or "corona discharge" increases the ion density beyond that of "chemi-ionization." This increase changes the ratio of charged particles to uncharged and drastically increases the collision frequency and causes highly intimate mixing. Since the electrical breakdown strength of a gas varies roughly as the square root of pressure, the conditions inside a combustion turbine imply a breakdown strength as much as three times that of air at atmospheric pressure. The electric field strengths that can be sustained before breakdown are therefore greater at these pressures, and the maximum drift velocities are expected to be correspondingly higher.

Any electric field control system must impart a sufficient energy to a sufficient quantity of charged particles to have an effect on the remaining uncharged mass. Previous efforts, generally, have either relied on the ionized particles being generated in the flame source by a process called "chemi-ionization," or by seeding the flame with highly reactive elements such as sodium, or potassium compounds. Neither of these processes are acceptable for combustion turbine applications. Chemi-ionization does not produce a sufficient charged particle concentration to be effective in a combustion turbine environment. Seeding with highly reactive sodium or potassium compounds will damage the combustion turbine.

Using the assumption that the only way to affect a flame is to change its apparent burning velocity, those experienced in the art have concluded that changes in blow off velocity could not be greater than 5.5 m/s (meters/second). Since a combustion turbine operates at much higher velocity, 80 m/s to 250 m/s, they have in turn concluded that using electric fields can not be used to substantially affect flames in a combustion turbine environment (that is, high temperature, high pressure, high gas velocity).

Factors, discovered as part of this invention, appear to mitigate the prevalence of gas flow velocity over electric field effects. A limiting velocity is only significant if the purpose of the electric field is to add stability to the flame by increasing its apparent burning velocity. If one is not looking to stabilize a higher burning velocity flame; but rather to improve mixing between the air and fuel at their boundary where differential velocity is significantly lower than the nozzle exit velocity, one need develop a process that improves mixing at the boundary layer. This may involve a mechanical mixing due to macroscopic particle interaction or it can include electrically enhanced momentum transfer between particles. The electric breakdown field strengths are therefore greater at these pressures and the maximum drift velocities are expected to be correspondingly higher.

Our experiments demonstrated the special effects that occur in the presence of a localized corona discharge. The corona discharges were observed to emanate from localized spots which indicate the presence of asperities on the burner surface. These asperities induce locally increased fields due to the sharp radius of curvature of the asperity. Under these conditions the combustible molecules are mixed more effectively and the flame is "anchored" to the local corona point. Utilizing this invention, it has been demonstrated that electric fields applied to flame combustion process can provide: reduction in a variety of emissions; alternate actuation means for actively suppressing combustion instabilities and for controlling flame configuration; and improvement in flame blow-off limits, enabling the use of higher flow velocities, leaner mixtures, or combinations of both.

Figure 3:
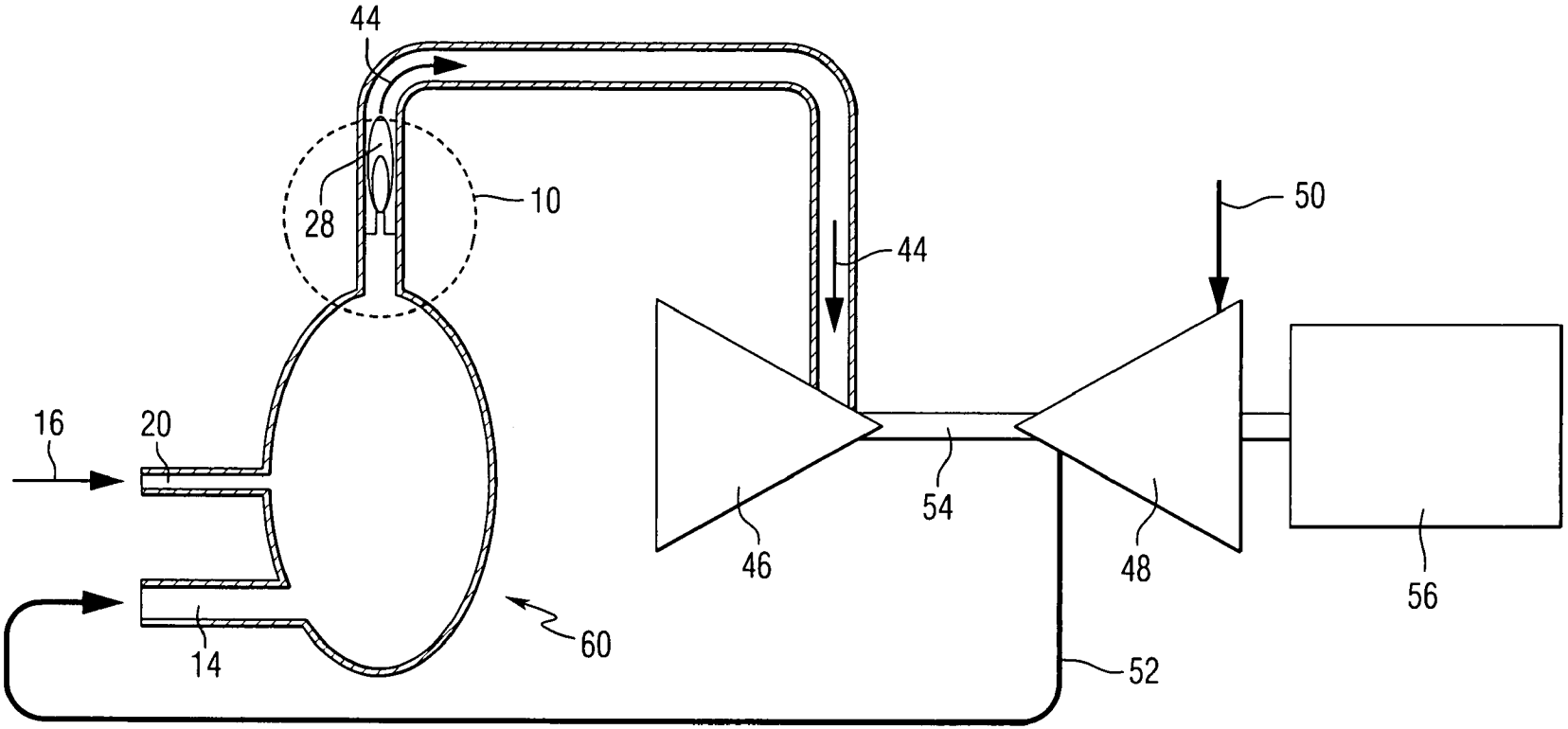
FIG. 3 is a schematic diagram of a combustor turbine generator system comprising a combustor, a gas turbine, an air compressor and an electric generator, where a premixing embodiment is shown.

FIG. 3 shows a simplified diagram of a combustor turbine generator system, where the combustor 10, utilizing at least one combustion flame 28 in combination with an electric field 34 (shown in FIG. 2) causes a corona discharge within a flow of mixed gaseous oxidant and gaseous fuel to provide combusted turbulent gas feed 44 to better power a gas turbine 46. The oxidant flow 52 and fuel flow 16 can be premixed in a premixer 60. Associated with the turbine 46 can be a compressor 48, for incoming air 50, to provide compressed air 52 which can be used in the combustor premixer 60. The turbine 46 contains rows of stationary vanes and rotating blades (not shown) causing the combusted gas feed 44 to expand thereby producing power to drive a rotor 54 to drive the compressor 48 as well as and electrical generator 56.

The invention will now be illustrated by the following, non-limiting example of one embodiment of the invention.

EXAMPLE

An apparatus was set up to combust air and methane fuel at the end of a methane fuel feed tube concentric within an air feed tube, essentially as shown in FIG. 1. The apparatus had a positive electrode placed above the end of the fuel feed tube, which tube was given a negative charge to make it a negative electrode such that an electric (static) field was generated between the electrodes along a flame axis parallel to the apparatus walls and parallel to the fuel feed tube and oxidant entry combustor walls. The inside diameter of the apparatus was about 2.2 cm, the outside diameter of the fuel feed tube was 0.5 cm and the outside diameter of the circular positive electrode, placed within the apparatus and above the fuel feed tube was 1.9 cm; its distance above the fuel feed tube was 10.0 cm. Methane was passed through the fuel feed tube at a rate of about 1.9 standard cubic feet/minute (53.8 liter/min) and pressurized air was passed around the fuel feed tube within the walls of the apparatus, at a rate of about 180 standard cubic feet/minute providing a 90:1 volume ratio of pressurized air: fuel.

A flame was then generated between the end of the fuel feed tube with the flame tip near the positive electrode. The flame was about 10.2 cm long with the electric field passing through the longitudinal axis of the flame. The end of the fuel feed tube constituted a burner which at the same time acted as a negative electrode. The voltage between the electrodes was 11 kV. The flow rate was maintained at the amount set forth above to just hold at a corona point at the asperity (flame holding) point, where corona discharge took place. As air swept past the methane fuel entry charged particles were generated and the combustion flame was just held (not blown off) at the fuel entry burner end.

This experimental apparatus clearly demonstrated the special effects that occur in the presence of a localized corona discharge. The corona discharges were observed to emanate from localized spots which indicate the presence of sharp asperities. These asperities induced locally increased fields due to sharp radius of curvature of the asperity. Under these conditions the corona produced a very high concentration of ionized gas molecules. The ionized gas molecules of air and methane were mixed intimately and effectively and the flame was anchored to the local corona point.

Whereas particular embodiments of this invention have been described above for purposes of illustration, it will be evident to those skilled in the art that numerous variations of the details of the present invention may be made without departing from the invention as defined in the appended claims.

What is claimed is:

1. A method for combusting gaseous fuel with a gaseous oxidant in a combustor comprising:

providing gaseous oxidant and a combustible gaseous fuel;

mixing the gaseous oxidant and gaseous fuel, where the gaseous oxidant has a velocity relative to the fuel which is sufficient to cause turbulent mixing with the fuel;

introducing a stable, field generated source of charged particles at the corona initiation source at a sharp contact point of the flame to an end of a fuel feed tube to increase a charged particle density; and combusting the gaseous oxidant and fuel in the region of a combustion flame and an electric field, where the electric field produces an electrical stress resulting in local breakdown of the mixture of gaseous oxidant and fuel, and a corona discharge that in turn generates intimate turbulent mixing of the gaseous oxidant and fuel.

2. The method of claim 1, wherein the oxidant and fuel are mixed near the combustion flame.

3. The method of claim 2, wherein the gaseous oxidant is air, pressurized from 1.5 atmospheres to 40 atmospheres and the combustible gaseous fuel is a hydrocarbon fuel.

4. The method of claim 2, wherein the electric field also influences turbulent mixing of the oxidant and fuel, improving combustion.

5. The method of claim 1, wherein the oxidant and fuel are first premixed and then passed to the combustion flame.

6. The method of claim 5, wherein the gaseous oxidant is air, pressurized from 1.5 atmospheres to 40 atmospheres and the combustible gaseous fuel is a hydrocarbon fuel.

7. The method of claim 5, wherein the electric field also influences turbulent mixing of the oxidant and fuel, improving combustion.

8. A method for combusting a gaseous fuel with a gaseous oxidant, prior to passing the hot combustion products to a gas turbine comprising:

feeding combustible gaseous fuel to an enclosed combustor through at least one fuel feed tube and providing at least one combustion flame within the enclosed combustor at the end of the fuel feed tube, the flame having a top flame tip and a bottom root end at the end of the feed tube;

feeding gaseous oxidant to contact gaseous fuel near the combustion flame;

providing an electric field in the region of the combustion flame;

introducing a stable, field generated source of charged particles at the corona initiation source at a sharp contact point of the flame to an end of a fuel feed tube to increase a charged particle density;

adjusting the velocity of the gaseous oxidant to provide turbulent flow and turbulent mixing with the gaseous fuel near the root end of the flame, to provide combustion and ionization of the gases at least at their contact interface;

adjusting the electric field to provide a corona discharge to enhance ionization and turbulent mixing of the gases which in turn improves combustion; and passing the hot combusted mixed gases to a gas turbine.

9. The method of claim 8, wherein the gaseous oxidant is air, pressurized from 1.5 atmospheres to 40 atmospheres and the combustible gaseous fuel is a hydrocarbon fuel.

10. The method of claim 8, wherein the electric field also influences turbulent mixing of the oxidant and fuel, improving combustion.

11. The method of claim 8, wherein the end of the fuel feed tube acts as a burner for the combustion flame.

12. The method of claim 8, wherein the volume ratio of gaseous fuel:gaseous oxidant is from about 1:5 to 1:100.

13. The method of claim 8, wherein the volume ratio of gaseous fuel gaseous oxidant is from about 1:5 to about 1:75.

14. The method of claim 8, wherein the gaseous oxidant at entry into the combustor has a velocity of from about 50 meters/sec. to about 2000 meters/sec.

15. The method of claim 8, wherein the gaseous oxidant at entry into the combustor has a velocity of from about 60 meters/sec. to about 500 meters/sec.

16. The method of claim 8, wherein the electric field produces ionization concentrated at the boundary between the fuel and the oxidant.

17. A gas turbine system comprising a combustor, a gas turbine, an air compressor, and an electric generator; where the combustor combusts gaseous oxidant and gaseous fuel and feeds the hot gaseous combustion products to the gas turbine; where the combustor comprises:

a combustion flame within the combustor;

at least one entry for gaseous oxidant feed and gaseous fuel feed; and an electric field which is generated at or through the combustion flame, by an applied voltage where the electric field is effective to cause ionization resulting in a corona discharge, which increases turbulent flow mixing of the gaseous fuel and gaseous oxidant before they undergo a combustion reaction, wherein the voltage is applied at, or near a sharp contact point of the flame to an end of a fuel feed tube producing an increased charged particle density.

18. The gas turbine system of claim 17, wherein the electric field also improves combustion in the combustor.

19. The gas turbine system of claim 17, wherein the oxidant and fuel are mixed near the combustion flame.

20. The gas turbine system of claim 17, wherein the oxidant and fuel are first premixed and then passed to the combustion flame.

* * * * *